US007007758B2

(12) United States Patent
Zupanick et al.

(10) Patent No.: US 7,007,758 B2
(45) **Date of Patent: *Mar. 7, 2006**

(54) CAVITY POSITIONING TOOL AND METHOD

(75) Inventors: Joseph A. Zupanick, Pineville, WV (US); Lawrence W. Diamond, Rockwall, TX (US)

(73) Assignee: CDX Gas, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/052,664

(22) Filed: Feb. 7, 2005

(65) Prior Publication Data

US 2005/0139358 A1 Jun. 30, 2005

Related U.S. Application Data

(63) Continuation-in-part of application No. 10/197,121, filed on Jul. 17, 2002, now Pat. No. 6,851,479.

(51) Int. Cl.
*E21B 23/00* (2006.01)

(52) U.S. Cl. ..... 166/369; 166/105; 166/212; 166/217; 166/243

(58) Field of Classification Search ..... 166/369, 166/105, 212, 206, 243, 68.5, 100, 217; 175/267, 230, 99
See application file for complete search history.

(56) References Cited

U.S. PATENT DOCUMENTS

| | | | | |
|---|---|---|---|---|
| 55,144 A | | 4/1866 | Hamar | |
| 274,740 A | | 3/1883 | Douglas | |
| 526,708 A | | 10/1894 | Horton | |
| 639,036 A | | 12/1899 | Heald | |
| 1,189,560 A | | 7/1916 | Gondos | |
| 1,285,347 A | | 11/1918 | Otto | |
| 1,317,192 A | | 9/1919 | Jones | |
| 1,467,480 A | | 9/1923 | Hogue | |
| 1,485,615 A | | 3/1924 | Jones | |
| 1,498,463 A | | 6/1924 | McCloskey et al. | |
| 1,589,508 A | | 6/1926 | Boynton | |
| 1,674,392 A | | 6/1928 | Flansburg | |
| 1,710,998 A | | 4/1929 | Rudkin | |
| 1,970,063 A | | 8/1934 | Steinman | |
| 2,013,457 A | * | 9/1935 | Burt | 175/77 |
| 2,018,285 A | | 10/1935 | Schweitzer et al. | |

(Continued)

FOREIGN PATENT DOCUMENTS

CA 1067819 12/1979

(Continued)

OTHER PUBLICATIONS

Notification of Transmittal of the International Search Report or the Declaration (PCT Rule 44.1) mailed Sep. 2, 2003 (8 pages) re International Application No. PCT/US 03/14828, May 12, 2003.

(Continued)

*Primary Examiner*—Hoang Dang
(74) *Attorney, Agent, or Firm*—Fish & Richardson P.C.

(57) ABSTRACT

A cavity positioning tool includes a housing adapted to be coupled to a downhole string. The cavity positioning tool includes at least one blunt arm pivotally coupled to the housing. Each blunt arm is configured to contact a surface of the cavity to position the tool in the cavity. The cavity positioning tool also includes a piston slidably disposed within the housing. The piston is operable to engage each blunt arm. The piston is also operable to receive an axial force operable to slide the piston relative to the housing. The sliding of the piston extends each blunt arm radially outward relative to the housing from a retracted position.

14 Claims, 6 Drawing Sheets

U.S. PATENT DOCUMENTS

| | | | | |
|---|---|---|---|---|
| 2,028,285 | A | | 1/1936 | Jephson et al. |
| 2,031,353 | A | | 2/1936 | Woodruff |
| 2,069,482 | A | | 2/1937 | Seay |
| 2,150,228 | A | | 3/1939 | Lamb |
| 2,169,502 | A | | 8/1939 | Santiago |
| 2,169,718 | A | | 8/1939 | Boll et al. |
| 2,290,502 | A | | 7/1942 | Squires |
| 2,450,223 | A | | 9/1948 | Barbour |
| 2,490,350 | A | | 12/1949 | Grable |
| 2,679,903 | A | | 6/1954 | McGowen, Jr. et al. |
| 2,847,189 | A | | 8/1958 | Shook |
| 3,087,552 | A | | 4/1963 | Graham |
| 3,126,065 | A | | 3/1964 | Chadderdon |
| 3,339,647 | A | | 9/1967 | Kammerer, Jr. |
| 3,379,266 | A | | 4/1968 | Fletcher |
| 3,397,750 | A | | 8/1968 | Wicklund |
| 3,443,648 | A | | 5/1969 | Howard |
| 3,528,516 | A | | 9/1970 | Brown |
| 3,661,205 | A | * | 5/1972 | Belogey ..... 166/66.4 |
| 3,684,041 | A | | 8/1972 | Kammerer, Jr. et al. |
| 3,757,876 | A | | 9/1973 | Pereau |
| 3,757,877 | A | | 9/1973 | Leathers |
| 4,073,351 | A | | 2/1978 | Baum |
| 4,158,388 | A | | 6/1979 | Owen et al. |
| 4,169,510 | A | | 10/1979 | Meigs |
| 4,189,184 | A | | 2/1980 | Green |
| 4,243,099 | A | | 1/1981 | Rodgers, Jr. |
| 4,278,137 | A | | 7/1981 | Van Eek, deceased |
| 4,323,129 | A | | 4/1982 | Cordes |
| 4,366,988 | A | | 1/1983 | Bodine |
| 4,396,076 | A | | 8/1983 | Inoue |
| 4,401,171 | A | | 8/1983 | Fuchs |
| 4,407,376 | A | | 10/1983 | Inoue |
| 4,494,616 | A | | 1/1985 | McKee |
| 4,549,630 | A | | 10/1985 | Brown |
| 4,558,744 | A | | 12/1985 | Gibb |
| 4,565,252 | A | | 1/1986 | Campbell et al. |
| 4,618,009 | A | | 10/1986 | Carter et al. |
| 4,674,579 | A | | 6/1987 | Geller et al. |
| 4,715,440 | A | | 12/1987 | Boxell et al. |
| 4,830,105 | A | | 5/1989 | Petermann |
| 4,887,668 | A | | 12/1989 | Lynde et al. |
| 4,960,173 | A | * | 10/1990 | Cognevich et al. ..... 166/241.1 |
| 5,036,921 | A | | 8/1991 | Pittard et al. |
| 5,135,058 | A | | 8/1992 | Millgard et al. |
| 5,148,875 | A | | 9/1992 | Karlsson et al. |
| 5,197,553 | A | | 3/1993 | Leturno |
| 5,201,817 | A | | 4/1993 | Hailey |
| 5,242,017 | A | | 9/1993 | Hailey |
| 5,255,741 | A | | 10/1993 | Alexander |
| 5,271,472 | A | | 12/1993 | Leturno |
| 5,348,091 | A | | 9/1994 | Tchakarov et al. |
| 5,363,927 | A | | 11/1994 | Frank |
| 5,385,205 | A | | 1/1995 | Hailey |
| 5,392,862 | A | | 2/1995 | Swearingen |
| 5,402,856 | A | | 4/1995 | Warren et al. |
| 5,413,183 | A | | 5/1995 | England |
| 5,494,121 | A | | 2/1996 | Nackerud |
| 5,499,687 | A | | 3/1996 | Lee |
| 5,722,489 | A | | 3/1998 | Lambe et al. |
| 5,853,054 | A | | 12/1998 | McGarian et al. |
| 5,979,550 | A | * | 11/1999 | Tessier ..... 166/212 |
| 6,070,677 | A | | 6/2000 | Johnston, Jr. |
| 6,082,461 | A | | 7/2000 | Newman et al. |
| 6,217,260 | B1 | | 4/2001 | He |
| 6,227,312 | B1 | | 5/2001 | Eppink et al. |
| 6,378,626 | B1 | | 4/2002 | Wallace |
| 6,412,556 | B1 | | 7/2002 | Zupanick |
| 6,454,000 | B1 | | 9/2002 | Zupanick |
| 6,494,272 | B1 | | 12/2002 | Eppink et al. |
| 6,575,255 | B1 | | 6/2003 | Rial et al. |
| 6,591,922 | B1 | | 7/2003 | Rial et al. |
| 6,595,301 | B1 | | 7/2003 | Diamond et al. |
| 6,595,302 | B1 | | 7/2003 | Diamond et al. |
| 6,644,422 | B1 | | 11/2003 | Rial et al. |
| 6,722,452 | B1 | | 4/2004 | Rial et al. |
| 2004/0011560 | A1 | | 1/2004 | Rial et al. |
| 2004/0084183 | A1 | | 5/2004 | Zupanick |

FOREIGN PATENT DOCUMENTS

| | | |
|---|---|---|
| WO | WO 01/83932 | 11/2001 |

OTHER PUBLICATIONS

Notification of Transmittal of the International Search Report or the Declaration (PCT Rule 44.1) mailed Jul. 4, 2003 (10 pages) re International Application No. PCT/US 03/04771, Jul. 4, 2003.

Nackerud Product Description Received, Sep. 27, 2001.

Monty H. Rial, et al., Pend. Pat. App., "Pantograph Underreamer," U.S. Appl. No. 09/929,175, Aug. 13, 2002.

Monty H. Rial, Pend Pat. App., "Pantography Underreamer, " U.S. Appl. No. 10/079,444, Feb. 19, 2002.

Joseph A. Zupanickm Pend. Pat. App., "Wedge Activated Underreamer," U.S. Appl. No. 10/160,425, May 31, 2002.

Joseph A. Zupanick, Pend. Pat. Appl. "Actuator Underreamer," U.S. Appl. No. 10/196,042, May 31, 2002.

Joseph A. Zupanick, Pend. Pat. App., "Cavity Positioning Tool and Method," U.S. Appl. No. 10/188,159, Jul. 1, 2002.

* cited by examiner

CAVITY POSITIONING TOOL AND METHOD

CROSS-REFERENCE TO RELATED APPLICATIONS

This application is a continuation in part of U.S. patent application Ser. No. 10/197,121, entitled "Cavity Positioning Tool and Method," and filed on Jul. 17, 2002, now U.S. Pat. No. 6,851,479, issued on Feb. 8,2005.

TECHNICAL FIELD

This invention relates generally to the field of downhole cavity tools and more particularly to a cavity positioning tool and method.

BACKGROUND

Subsurface resources such as oil, gas and water are typically recovered by drilling a well bore from the surface to a subterranean reservoir or zone that contains the resources. The well bore allows oil, gas and water to flow to the surface under its own pressure. For low pressure or depleted zones, rod pumps are often used to retrieve the fluids to the surface.

To facilitate drilling and production operations, cavities are sometimes formed in the production zone. Short extensions, or "rat holes," are often formed at the bottom of the cavity to collect cuttings and other drilling debris. As the subsurface liquids collect in the well bore, the heavier debris falls to the bottom of the rat hole and is thereby both centralized and collected out of the cavity. To avoid being clogged with debris, a pump inlet may be positioned within the cavity above the rat hole. The pump inlet may be positioned fairly low in the cavity (for example, below the fluid waterline) to avoid vapor lock. Traditional methods of positioning a pump inlet are sometimes inaccurate and inefficient, leading to clogging or vapor lock and increased maintenance and operations costs for the well.

SUMMARY

The present invention provides a cavity positioning tool and method that substantially eliminates or reduces at least some of the disadvantages and problems associated with previous cavity positioning tools and methods.

In accordance with a particular embodiment of the present invention, a cavity positioning tool includes a housing adapted to be coupled to a downhole string. The cavity positioning tool includes at least one blunt arm pivotally coupled to the housing. Each blunt arm is configured to contact a surface of the cavity to position the tool in the cavity. The cavity positioning tool also includes a piston slidably disposed within the housing. The piston is operable to engage each blunt arm. The piston is also operable to receive an axial force operable to slide the piston relative to the housing. The sliding of the piston extends each blunt arm radially outward relative to the housing from a retracted position.

In accordance with another embodiment, a method for positioning a downhole device relative to a subsurface cavity includes coupling a housing to a downhole string. The method includes providing the housing within the cavity with the downhole string. The housing is pivotally coupled to at least one blunt arm. Each blunt arm is configured to contact a surface of the cavity to position the tool in the cavity. A piston is slidably disposed within the housing. The piston is operable to engage each blunt arm. The method includes applying an axial force to the piston and extending the blunt arms radially outward from a retracted position relative to the housing in response to movement of the piston relative to the housing from the applied force.

Technical advantages of particular embodiments of the present invention include a cavity positioning tool with arms that are retractable for lowering through a well bore to a cavity and extendable in the cavity to position a device within or at a set relation to the cavity. Another technical advantage of particular embodiments of the present invention includes providing a method and system for positioning a tool or component, such as a pump inlet, in a cavity. A pump inlet may be positioned in a lower portion of the cavity by extending arms of the cavity positioning tool that contact a surface of the cavity at a particular position within the cavity. This positioning of a pump inlet may reduce clogging of the pump inlet and prevent the pump inlet from entering the rat hole. The cavity positioning tool may also be rotated so that the arms agitate debris in the cavity to reduce clogging of the pump inlet. Vapor lock may also be minimized.

Other technical advantages will be readily apparent to one skilled in the art from the following figures, descriptions and claims included herein. Moreover, while specific advantages have been enumerated above, various embodiments may include all, some or none of the enumerated advantages.

DESCRIPTION OF DRAWINGS

For a more complete understanding of particular embodiments of the invention and their advantages, reference is now made to the following descriptions, taken in conjunction with the accompanying drawings, in which.

DETAILED DESCRIPTION

Figure 1:
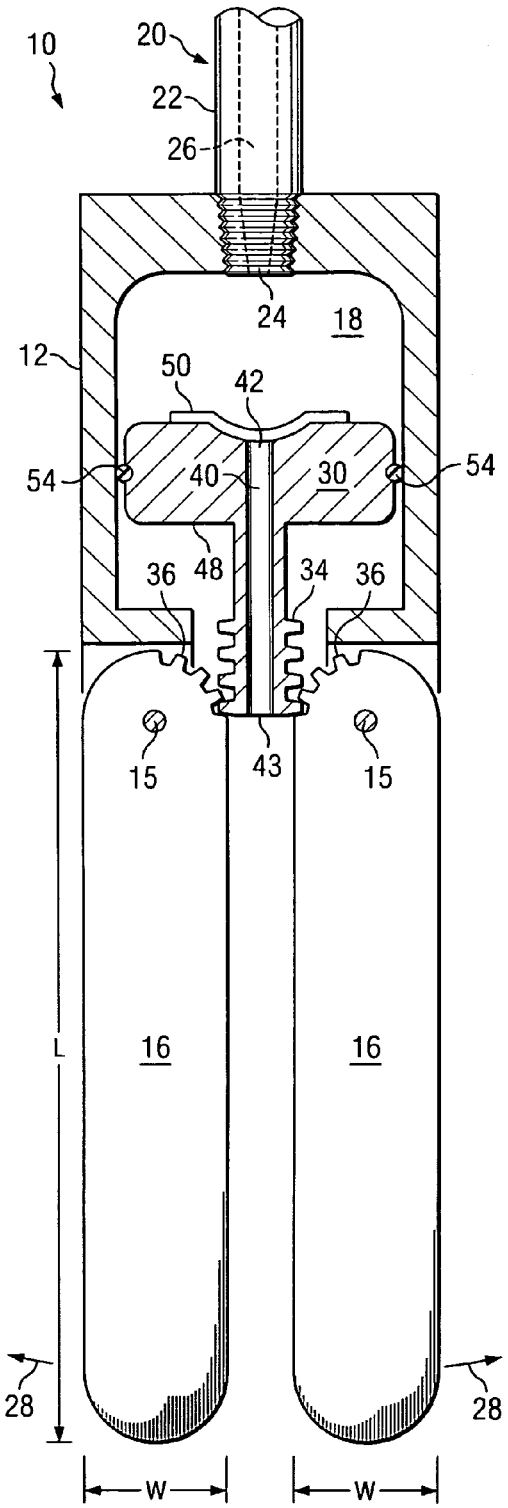
FIG. 1 illustrates an example cavity positioning tool in accordance with an embodiment of the present invention.
Figure 2:
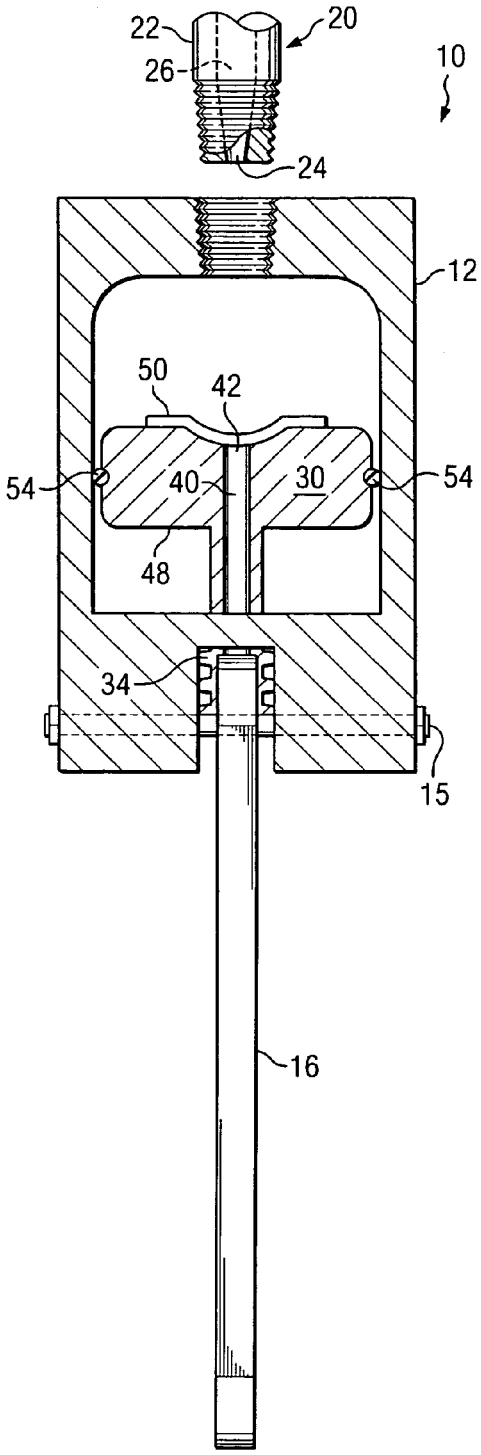
FIG. 2 illustrates is a side view of the cavity positioning tool of FIG. 1.

FIGS. 1 and 2 illustrate an example cavity positioning tool 10 in accordance with an embodiment of the present invention. FIG. 1 illustrates a front view, and FIG. 2 illustrates a side view, of cavity positioning tool 10. In this embodiment, cavity positioning tool 10 is adapted to position a pump inlet in a subsurface cavity. Cavity positioning tool 10 may be adapted to position other suitable devices within or in relation to a cavity. For example, motors, controllers and valves may be positioned in or relative to a cavity within cavity positioning tool 10. Cavity positioning tool 10 may be constructed of steel or other suitable materials in order to resist damage in a subsurface, downhole environment.

Cavity positioning tool 10 includes a housing 12 and blunt arms 16 pivotally coupled to housing 12. In this embodiment, cavity positioning tool 10 includes two blunt arms 16; however, cavity positioning tools in accordance with other embodiments may include either one or more than two blunt arms 16. Blunt arms 16 are operable to be radially extended outward from a first position of substantial alignment with a longitudinal axis of housing 12 to a second position. In this embodiment, each of blunt arms 16 is pivotally coupled to housing 12 via a clevis and pin 15 assembly; however, other suitable methods may be used to provide pivotal or rotational movement of blunt arms 16 relative to housing 12.

Housing 12 is configured at one end to couple to a downhole string 20. In the illustrated embodiment, housing 12 is threadably coupled to downhole string 20; however, other suitable methods may be used to couple housing 12 and downhole string 20, such as clamps or interlocking pieces. Housing 12 may be an integrated piece or a combination of components. For example, housing 12 may include a tubing rotator for rotating the housing relative to downhole string 20.

Downhole string 20 may be a drill string, pump string, pipe, wireline or other suitable downhole device that can be used to dispose cavity positioning tool 10 within a cavity. In the illustrated embodiment, downhole string 20 is a pump string 22. Pump string 22 includes an inlet 24 and an internal passage 26 for the flow of fluid to and from cavity positioning tool 10. Pump string 22 is coupled directly to cavity positioning tool 10. Pump string 22 may be part of a sucker or other rod or multistage pump, a downhole pump with piping to the surface, or other suitable pumping system.

Blunt arms 16 are rounded, dull, or otherwise shaped so as to prevent substantial cutting of or damage to the cavity. In the illustrated embodiment, blunt arms 16 are cylindrical in shape with an elongated body and having a circular cross-section. As illustrated, blunt arms 16 are in substantial alignment with the longitudinal axis of housing 12 when in a retracted position. As described in more detail below, in response to an axial force applied to piston 30, blunt arms 16 may be radially extended towards a generally perpendicular position relative to housing 12.

Blunt arms 16 are sized to fit within a cavity when in an extended position and to exceed a diameter of a rat hole, bore hole or other extension below the cavity. In particular embodiments, blunt arms 16 have a length L of approximately 24 inches and a width W of approximately 1.5 to 2 inches.

Cavity positioning tool 10 also includes a piston 30 slidably disposed within an internal cavity 18 of housing 12. Piston 30 includes an internal fluid passage 40 with an opening 42. Piston 30 also includes an integrally formed rack 34 adapted to engage a corresponding integrally formed pinion 36 of each of blunt arms 16. In FIG. 1, the blunt arms 16 are illustrated in a retracted position relative to housing 12. In response to downward movement of piston 30 relative to housing 12, teeth of rack 34 engage teeth of each of pinions 36, thereby causing rotation of blunt arms 16 about pins 15 in the directions indicated generally at 28 and extending blunt arms 16 radially outward relative to housing 12.

A flow restrictor 50 is disposed over opening 42 of internal fluid passage 40. In this embodiment, flow restrictor 50 is a deformable member. Piston 30 also includes an outwardly facing annular shoulder 48. A seal 54 is disposed around outwardly facing shoulder 48 of piston 30. Seal 54 may include an elastomer O-ring type seal for restricting fluid movement to predetermined locations of cavity positioning tool 10. However, it should be understood that other suitable types of sealing members may also be used.

In operation, the pressurized fluid disposed through internal passage 26 of pump string 22 applies an axial force to piston 30 (including flow restrictor 50), thereby causing downward movement of piston 30 relative to housing 12. The pressurized fluid may comprise a gas, a liquid, a gas/liquid combination, or other suitable pressurized fluid substance. In this embodiment, flow restrictor 50 is constructed having a predetermined deformation pressure. The deformation pressure is the pressure at which flow restrictor 50 deforms to allow the pressurized fluid to enter internal fluid passage 40. For example, flow restrictor 50 may be constructed such that deformation occurs at approximately 500 pounds per square inch (psi). Thus, flow restrictor 50 substantially prevents the pressurized fluid from entering internal fluid passage 40 at fluid pressures below the deformation pressure, thereby maintaining a downwardly directed force applied to piston 30.

As piston 30 moves downwardly relative to housing 12, rack 34 of piston 30 engages pinion 36 of each of blunt arms 16, thereby causing rotation of blunt arms 16 about pins 15 and corresponding outward radial movement of blunt arms 16 from a retracted position in the directions indicated generally at 28. A rotational force may be applied to housing 12 by suitable equipment located at the surface or otherwise, such as a tubing rotator to circulate blunt arms 16 within cavity 14.

In the embodiment illustrated in FIG. 1, the pressure of the fluid disposed through internal passage 26 may be increased to a level exceeding the predetermined deformation pressure associated with flow restrictor 50 such that flow restrictor 50 deforms, thereby providing fluid communication from internal passage 26 of pump string 22 to internal fluid passage 40 of piston 30. When flow restrictor 50 deforms in such a manner, it passes through and exits internal fluid passage 40 through an opening 43 of internal fluid passage 40. In particular embodiments, the flow restrictor may rupture upon a certain pressure to provide fluid communication between the internal passage of the pump string and the internal fluid passage of the piston. Correspondingly, the fluid within the internal fluid passage 40 is communicated outwardly through opening 43.

Figure 3:
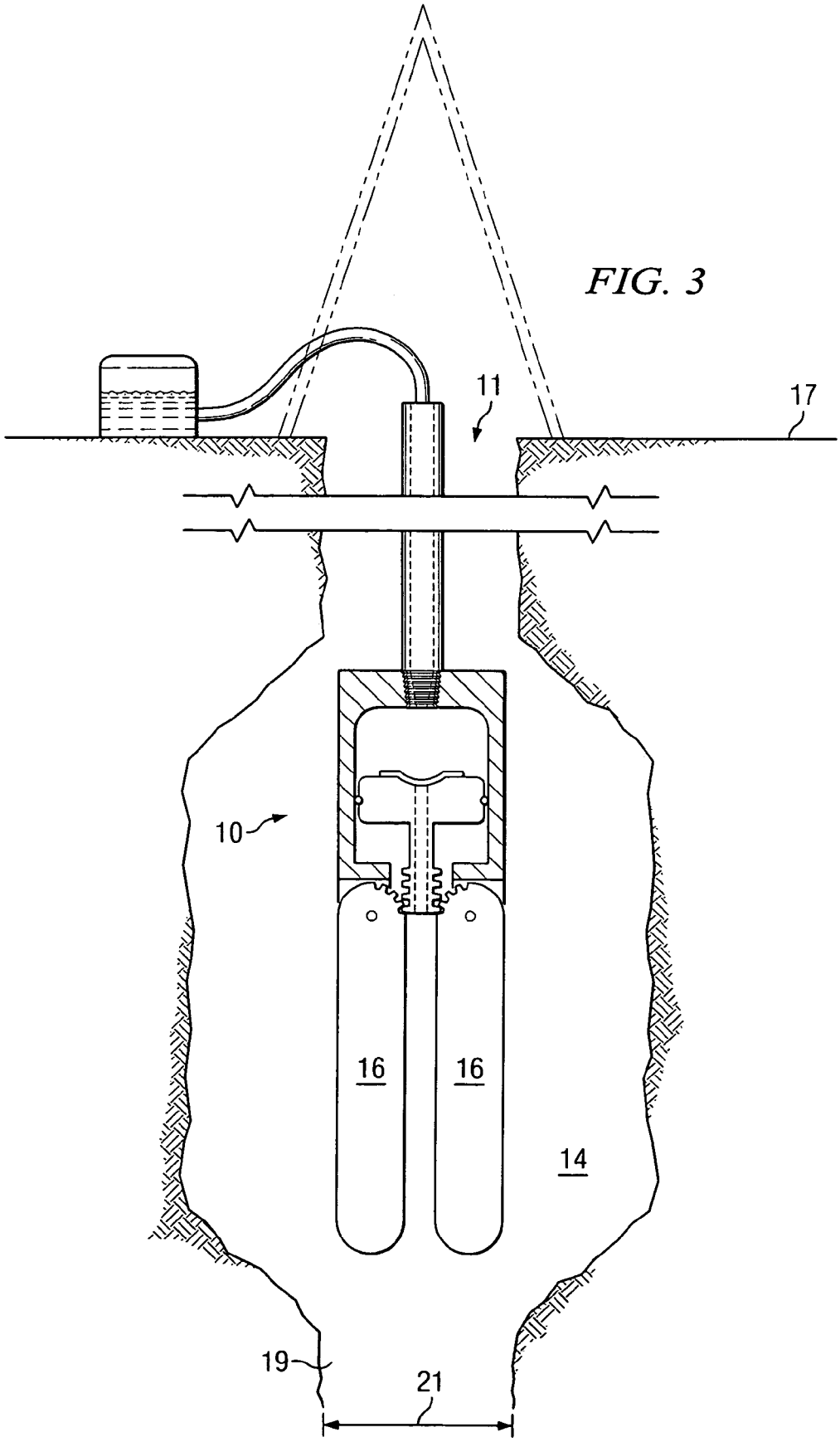
FIG. 3 illustrates the cavity positioning tool of FIG. 1 disposed in a cavity and with blunt arms in a retracted position.

FIG. 3 illustrates cavity positioning tool 10 of FIGS. 1 and 2 disposed within enlarged cavity 14 formed from within a well bore 11. Well bore 11 is drilled from a surface 17. Cavity 14 may be formed within a coal seam or other subterranean zone. Forming cavity 14 creates a rat hole 19 of well bore 11 below cavity 14. Rat hole 19 has a diameter 21. In a particular embodiment, length L of blunt arms 16 is such that when blunt arms 16 are extended, the distance from the distal end of one blunt arm 16 to the distal end of another blunt arm 16 exceeds diameter 21. While cavity positioning tool 10 is lowered into well bore 11 and positioned within cavity 14, blunt arms 16 remain in a retracted position, as illustrated.

Figure 4:
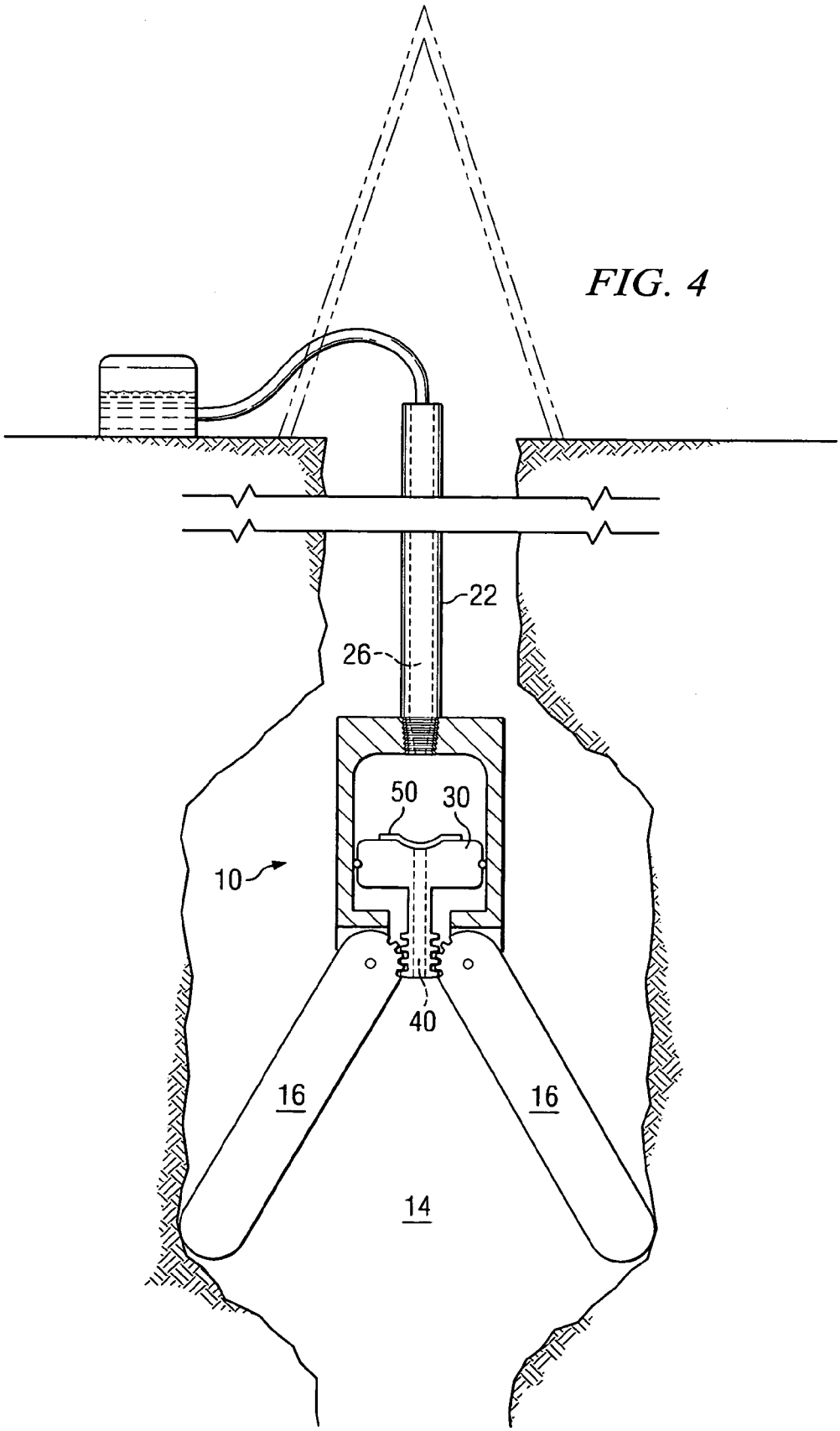
FIG. 4 illustrates the cavity positioning tool of FIG. 1 disposed in a cavity and with blunt arms in an extended position.

FIG. 4 illustrates cavity positioning tool 10 disposed within enlarged cavity 14 with blunt arms 16 in an extended position. Blunt arms 16 are extended by disposing a pressurized fluid through internal passage 26 of pump string 22, wherein the pressurized fluid applies an axial force downward upon flow restrictor 50. An operator of cavity positioning tool 10 may log the diameter of cavity 14 at different depths based upon the amount or pressure of the fluid used to extend blunt arms 16. For example, given a certain amount of pressurized fluid used to push down piston 30, one can determine the distance piston 30 has moved and, consequently, the degree to which blunt arms 16 have extended. Using this information, an operator can calculate the diameter of cavity 14 at particular depths and can thus determine the complete dimensions of cavity 14. Cavity positioning tool 10 may then be positioned as desired for pumping.

Once cavity positioning tool 10 has been positioned as desired, the pressure of the pressurized fluid disposed through internal passage 26 may be increased above the deformation pressure of flow restrictor 50 such that flow restrictor 50 deforms and passes through internal fluid passage 40 of piston 30 into cavity 14. Once this occurs, internal passage 26 of pump string 22 will be in fluid communication with internal fluid passage 40 of piston 30.

Other embodiments may utilize different types of fluid restrictors to allow the internal passage of the pump string to be in fluid communication with the internal fluid passage of the piston. For example, in particular embodiments a pump may be used to provide pump pressure to deform the fluid restrictor. In this instance, the flow restrictor may pass upward through the internal passage of the pump string.

Figure 5:
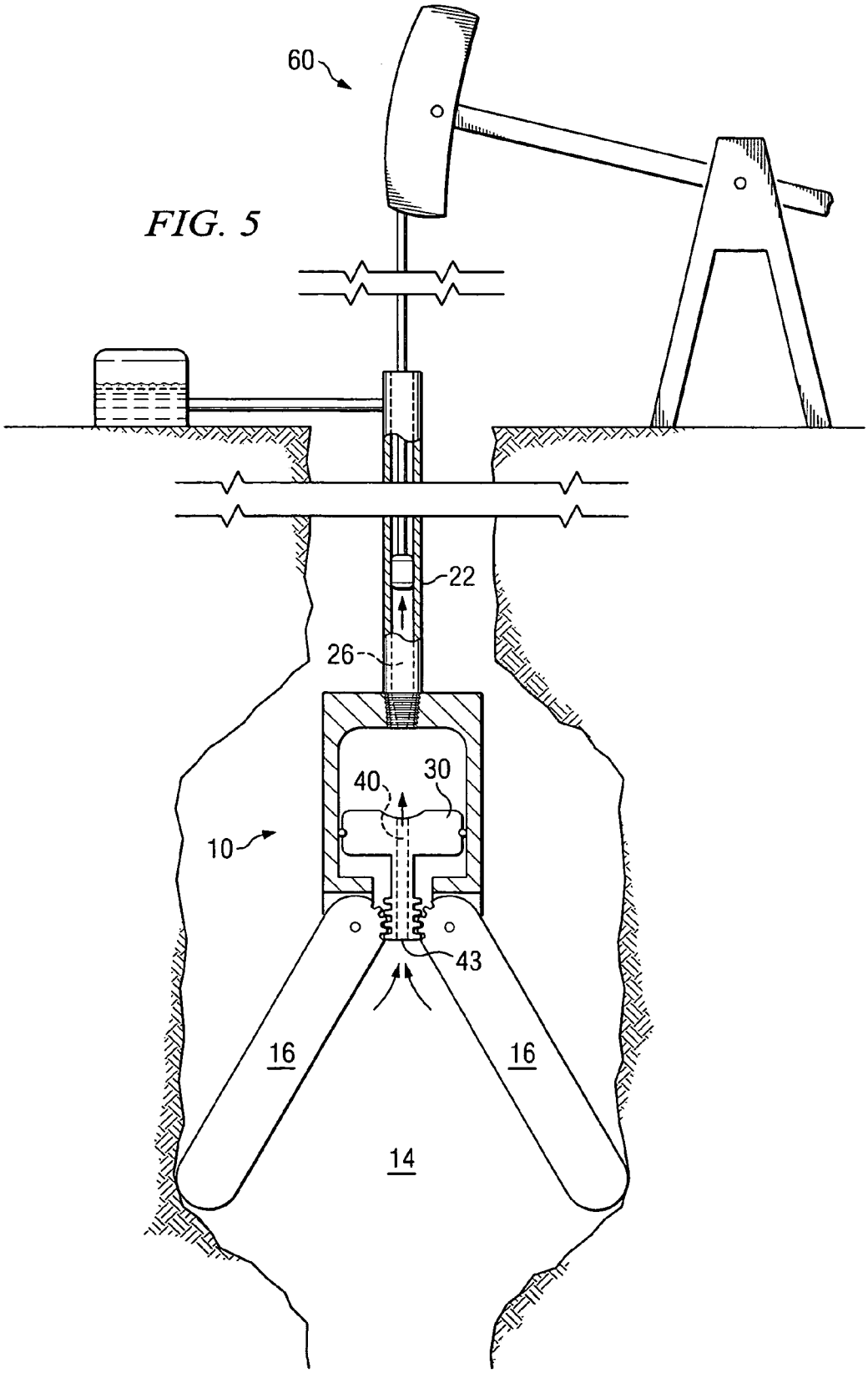
FIG. 5 illustrates the cavity positioning tool of FIG. 1 disposed in a cavity and utilizing a pump system for pumping fluids from the cavity.

FIG. 5 illustrates cavity positioning tool 10 disposed within cavity 14 with blunt arms 16 in an extended position. A pump system 60 is partially disposed within pump string 22. Pump system 60 is used to pump fluids or other materials from cavity 14. Such fluids or other materials may have been drained from a drainage pattern formed within a subterranean zone surrounding cavity 14. Fluids may be continuously or intermittently pumped as needed to remove the fluids from cavity 14. The fluids or other materials are pumped through opening 43 of internal fluid passage 40 of piston 30. They flow through internal fluid passage 40 and up through internal passage 26 of pump string 22. It should be understood that in particular embodiments of the present invention, fluids from the cavity may be pumped to the surface while the arms of the cavity positioning tool rest on the bottom of the cavity flow, for example, as the pump inlet is positioned above the rat hole.

Thus, particular embodiments of the present invention provide a reliable manner to locate a tool or component, such as a pump inlet in a desired location in a cavity. The pump inlet may be located at a certain position in the cavity to reduce clogging of the pump inlet and prevent the pump inlet from entering the rat hole. Vapor lock may also be minimized.

In particular embodiments, cavity positioning tool 10 may be rotated by rotating the downhole string to which cavity positioning tool 10 is coupled. Such rotation may agitate fluid collected within cavity 14. In the absence of agitation, the particulate matter and other debris may coalesce or clump together forming larger composite matter that may eventually clog opening 43. With rotation of cavity positioning tool 10 and thus blunt arms 16, however, solids remain suspended in the fluid and are removed with the fluid. The rotation of cavity positioning tool 10 may also be accomplished by other means, such as through the use of a tubing rotator coupled to the housing.

Particular embodiments of the present invention may include a type of flow restrictor different from a deformable member. For example, some embodiments may include an elastomer object, such as an elastomer ball, disposed over opening 42 of internal fluid passage 40 of piston 30. An axial force applied to the elastomer object from the pressurized fluid acts to move piston 30 and extend blunt arms 16 as described above. Upon an increase of the axial force and deformation of the elastomer object, the elastomer object passes through internal fluid passage 40 and into cavity 14, thereby providing fluid communication between internal passage 26 of pump string 22 and internal fluid passage 40 of piston 30. Thus, fluid and other materials may be pumped out of cavity 14 through such passages. Other embodiments may include a rupture disc that ruptures upon a certain pressure to provide fluid communication between internal passage 26 of pump string 22 and internal fluid passage 40 of piston 30.

Some embodiments may use a nozzle or relief valve to resist flow of the pressurized fluid into the internal fluid passage of the piston thereby resulting in an axial force applied to the piston. For example, a nozzle may be closed when a fluid is disposed through the internal passage of the pump string thereby resulting in an axial force applied to the piston. The nozzle may be opened to provide fluid communication between the internal passage of the pump string and the internal fluid passage of the piston when desired for pumping materials out of the cavity. Other techniques, such as a relief valve or check valve, may also be used that resist flow in one direction until a certain pressure is applied thereby providing an axial force to the piston, but allow flow in the other direction thereby providing fluid communication for pumping.

Particular embodiments may utilize a cavity positioning tool having a piston that may be removed after the blunt arms have been extended and the tool positioned in the cavity as desired. In such embodiments, the width of the internal passage of the downhole string may have to be wide enough so that the piston could be removed through the downhole string after the blades have been extended and before the pumping of fluids and other materials from the cavity begins. In some embodiments, a weight may be positioned in the tool using a wireline, such that the weight rests on the piston applying the axial force to cause the piston to move down and extend the arms of the tool. The weight may be removed once the tool is positioned in the cavity.

Figure 6:
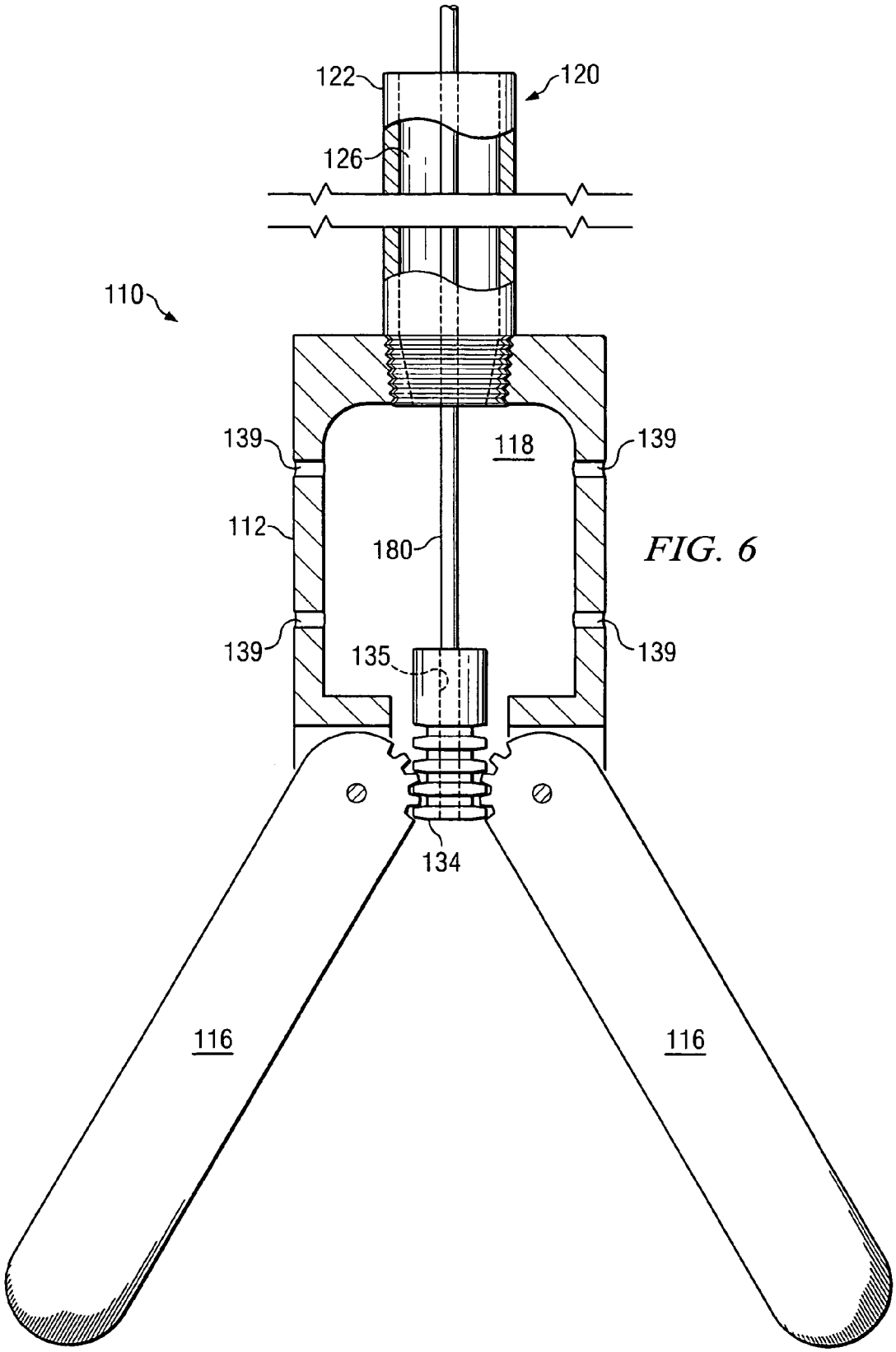
FIG. 6 illustrates an example cavity positioning tool with segmented rods contacting the rack of the tool in accordance with another embodiment of the present invention.

FIG. 6 illustrates a cavity positioning tool 110 in accordance with another embodiment of the present invention. Cavity positioning tool 110 is similar to cavity positioning tool 10 of FIGS. 1 and 2. However, in this embodiment, segmented rods 180 are disposed through internal passage 126 of downhole string 120 such that an axial force applied to rods 180 forces a rack 134 down such that blunt arms 116 extend outwardly. The axial force may be applied in any number of ways, such as from the surface by an operator pushing down on rods 180. Thus, a pressurized fluid may not be needed to extend blunt arms 116 in this embodiment. In the illustrated embodiment, rods 180 are not coupled to rack 134 but are illustrated as contacting rack 134 to apply the axial force.

Once rack 134 has been moved down and blunt arms 116 have consequently been extended as desired, an operator may log dimensions of the cavity in which cavity positioning tool 110 is positioned. Rack 134 includes an internal passage 135 through which fluids may be pumped from the cavity. Housing 112 includes ports 139 through which fluids may flow into internal cavity 118 of housing 112 for pumping. Particular embodiments of the present invention may include ports in housing for fluid flow, a rack with an internal passage for fluid pumping or both. In some embodiments the rack may be removed once the tool is positioned in the cavity to provide a passage for fluids to enter the internal cavity of the housing.

The various embodiments described above each present techniques for extending blunt arms in response to an axial force on a body disposed within a housing. The bodies described above include pistons, racks, and segmented rods, but in principle, any body might be used. Furthermore, various techniques for exerting axial forces may be employed with a variety of different structures. Although particular methods of exerting axial forces are described, including hydraulic pressure, weight, and pushing from the surface, other methods may also be used. For example, the rack-and-pinion assembly could be replaced with a hydraulic system, such that hydraulic pressure drives the blunt arms radially outward in response to an axial force exerted on the hydraulic system. Some examples of such variations are described below.

Figure 7:
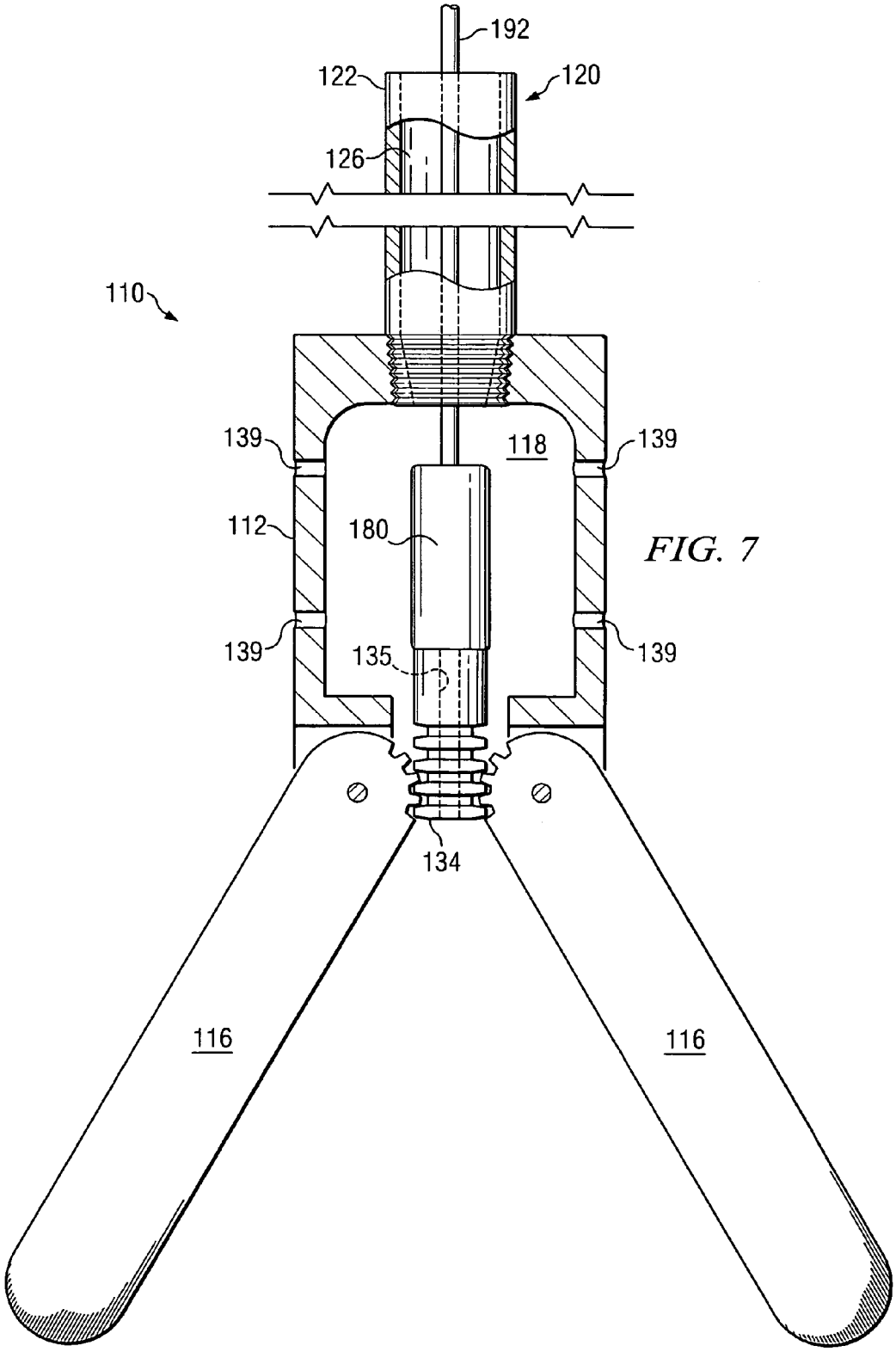
FIG. 7 illustrates an example cavity positioning tool in which a weight is lowered onto a rack to extend the blunt arms.

FIG. 7 illustrates an alternative embodiment of the cavity positioning tool 110 in which a weight 190 that is lowered from the surface on a wireline 192 is used as an alternative to segmented rods 180. The weight 190 may be lowered onto the rack 134 to exert an axial force that causes the rack 134 to act on the blunt arms 116 and to extend the blunt arms 116 radially outward relative to the housing 112. Removing the weight 190 causes the blunt arms 116 to retract. The weight 190 may take many forms. In one example, the weight 190 is a sinker bar having a weight selected to extend the blunt arms 116 radially outward. In some instances, the weight 190 can extend the blunt arms 116 into engagement with the interior of the well bore into which the cavity positioning tool 110 is lowered.

In operation, the cavity positioning tool 110 is lowered on a tubing or pump string 112 into the well bore. As the cavity positioning tool 110 approaches the vicinity of a cavity, the weight 190 is lowered onto the rack 134 to extend the blunt arms 116. The cavity positioning tool 110 is then lowered until the blunt arms 116 contact the bottom of the cavity. The full weight of the pump string 122 may then be supported by the blunt arms 116, which additionally locate the end of the pump string 122 in relation to the cavity. As above, fluid may be pumped through the tool 110 using the internal passage 135 in the rack 134. Alternative, the rack 134 may be removed to allow fluid to flow directly into the housing 112.

Although the present invention has been described in detail, various changes and modifications may be suggested to one skilled in the art. It is intended that the present invention encompass such changes and modifications as falling within the scope of the appended claims.

What is claimed is:

1. A cavity positioning tool, comprising:

a housing adapted to be coupled to a tubing string;

at least one blunt arm coupled to the housing, each blunt arm configured to contact a surface of a cavity to position the tool within the cavity;

a rack coupled to the at least one blunt arm and operable to radially extend the at least one blunt arm in response to an axial force exerted on the rack, the rack comprising an internal fluid passage disposed in fluid communication with an internal passage of the tubing string; and a rod operable to exert at least a portion of the axial force by pushing from a ground surface.

2. The tool of claim 1, wherein the rod comprises segmented rods operable to exert the axial force on the rack.

3. The tool of claim 1, wherein:

each of the at least one blunt arms comprises a pinion; and the rack is operable to engage each of the respective pinions.

4. The tool of claim 1, wherein the housing comprises ports allowing fluid to flow into an internal cavity of the housing.

5. A cavity positioning tool, comprising:

a housing adapted to be coupled to a tubing string;

at least one blunt arm coupled to the housing, each blunt arm configured to contact a surface of a cavity to position the tool within the cavity;

a rack coupled to the at least one blunt arm and operable to radially extend the at least one blunt arm in response to an axial force exerted at least in part by a weight operable to selectively exert the axial force on the rack, the rack comprising an internal fluid passage disposed in fluid communication with an internal passage of the tubing string.

6. The tool of claim 5, wherein the weight is suspended using a wireline.

7. A method for positioning a device relative to a subsurface cavity, comprising:

coupling a housing to a string, wherein the housing comprises an internal fluid passage disposed in fluid communication with the string;

coupling one or more blunt arms to the housing, wherein the one or more blunt arms is configured to contact a surface of the subsurface cavity to position the tool within the cavity;

disposing the housing within the subsurface cavity;

applying an axial force to a body coupled to the blunt arms; and extending the one or more blunt arms radially outward relative to the housing in response to the axial force;

wherein applying the axial force comprises applying a weight to the body.

8. The method of claim 7, wherein:

the body comprises a rack engaging a pinion on each of the blunt arms; and extending the one or more blunt arms comprises moving the rack downward.

9. The method of claim 7, wherein applying the weight comprises lowering the weight onto the body.

10. The method of claim 7, wherein applying the weight comprises resting the weight on the body.

11. The method of claim 10, wherein the weight is a sinker bar depending from a wireline.

12. The method of claim 7, further comprising pumping fluid from the cavity through the internal fluid passage.

13. The method of claim 12, wherein:

the body is disposed within the internal fluid passage; and the method further comprises removing the body from the internal fluid passage.

14. A method for positioning a device relative to a subsurface cavity, comprising:

coupling a housing to a string, wherein the housing comprises an internal fluid passage disposed in fluid communication with the string;

coupling one or more blunt arms to the housing, wherein the one or more blunt arms is configured to contact a surface of the subsurface cavity to position the tool within the cavity;

disposing the housing within the subsurface cavity;

applying an axial force to a body coupled to the blunt arms; and extending the one or more blunt arms radially outward relative to the housing in response to the axial force;

wherein:

the string extends from a ground surface; and applying the axial force comprises pushing the body from the ground surface.

* * * * *